United States Patent [19]

Harder et al.

[11] 4,217,197

[45] Aug. 12, 1980

[54] APPARATUS FOR REMOVING ANODE RESIDUE FROM ANODES OF ELECTROLYTIC MELT BATHS

[75] Inventors: Klaus Harder, Lünen; Martin Schwert, Werne, both of Fed. Rep. of Germany

[73] Assignee: Gewerkschaft Eisenhutte Westfalia, Lünen, Fed. Rep. of Germany

[21] Appl. No.: 58,344

[22] Filed: Jul. 18, 1979

[51] Int. Cl.[2] ..... B01K 3/00; C25C 3/00; C25C 3/06

[52] U.S. Cl. ..... 204/243 R; 204/243 M

[58] Field of Search ..... 204/243 R, 243 M, 228, 204/225

[56] References Cited

U.S. PATENT DOCUMENTS

| | | | |
|---|---|---|---|
| 3,674,674 | 7/1972 | Arts et al. | 204/225 |
| 3,728,243 | 4/1973 | Hatting | 204/243 R |
| 3,806,433 | 4/1974 | Diller | 204/243 R X |
| 4,119,505 | 10/1978 | Baillot et al. | 204/243 R X |

*Primary Examiner*—Arthur C. Prescott

*Attorney, Agent, or Firm*—Thompson, Birch, Gauthier & Samuels

[57] ABSTRACT

Apparatus for removing anode residue from the metallic projections of an anode used with an electrolytic melt comprising stripper jaws engageable about the projections and movable to and fro along the projections to break-off the anode residue thereon. In case of breakage of any of the projections, the stripper jaws carry sensors, conveniently inductive sensors, which provide a control signal should damage occur to the projections.

7 Claims, 3 Drawing Figures

APPARATUS FOR REMOVING ANODE RESIDUE FROM ANODES OF ELECTROLYTIC MELT BATHS

BACKGROUND TO THE INVENTION

The present invention relates in general to electrolytic melting plants and, more particularly, to apparatus used to remove anode residue from the anodes of such plants.

The anodes, usually carbon anodes, of electrolytic melting plants are consumed during operation and it is known to provide anodes with a plurality of metallic projections or nipples. Anode residue tends to build up on the anodes and it is necessary from time to time to remove this residue. For this purpose, it is known to utilize strippers which engage around the projections and which are moved therealong to strip off the residue. The residue thus removed is then usually transported by a conveyor to a breaker which breaks up the blocks into granular form suitable for re-processing. Because of the high forces exerted by the strippers on the metallic projections to strip off the residue, the metallic projections are sometimes damaged and fragments and portions of the metallic projections can be fed to the breaker with the anode residue. The metallic portions are then apt to damage the breaker.

The present invention seeks to provide an improved apparatus which will mitigate this problem.

SUMMARY OF THE INVENTION

In accordance with the present invention, a sensor is carried on at least one and preferably on each stripper member. The or each sensor then senses the presence or absence of part of the anode stripped by the supportive member. The or each sensor can thus sense the continuity of a metallic anode projection during the stripping operation and can signify when damage has occurred.

The sensor can take various forms such as mechanical fingers or feelers, but it is preferred to utilize a non-contacting device capable of providing a signal, preferably an electrical signal. For this purpose, an inductive sensor is quite suitable. It is useful to also employ limit switches which are actuated by the movement of the stripper members along the projections. Limit switches can be provided to initiate and halt the sensing operation over the normal range of stripping movement of the stripper members. Alternatively, the limit switches just actuated at or about the end of the range of movement of the stripper members—usually the lowermost position—can provide a pulse which causes the sensors to perform their sensing function. A control signal indicative of projection damage can be generated and used as an alarm and/or to halt the re-processing of the anode residues. A convenient arrangement is to utilize the control signal to halt the conveyor transporting the residues to the breaker. An operator can then locate and remove any metallic particles and re-start the conveyor.

The invention may be understood more readily and various other features of the invention may become apparent from consideration of the following description.

BRIEF DESCRIPTION OF DRAWING

An embodiment of the invention will now be described, by way of example only, with reference to the accompanying drawing, wherein.

DESCRIPTION OF PREFERRED EMBODIMENT

Figure 1:
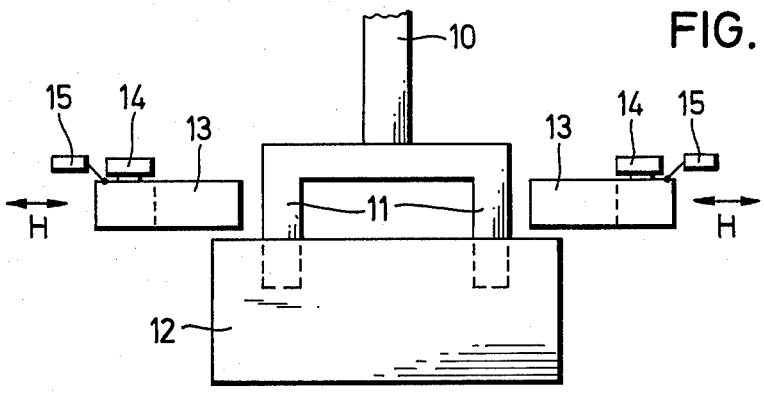
FIGS. 1 to 3 are diagrammatical representations of apparatus made in accordance with the invention in various operating positions.

As shown in the drawing, an anode rod 10 of an eletrolytic bath has two metal projections 11. The number of projections 11 can vary and two is merely illustrative. A block of anode residue 12 has attached itself to the projections 11.

Apparatus made in accordance with the invention serves to remove the block 12 from the anode 10,11 and is composed of stripper members or jaws 13 which are movable horizontally (arrow H) and vertically (arrow V). Thus, the members 13 can be selectively engaged around the projections 11 and moved vertically to break off the block 12.

Figure 2:
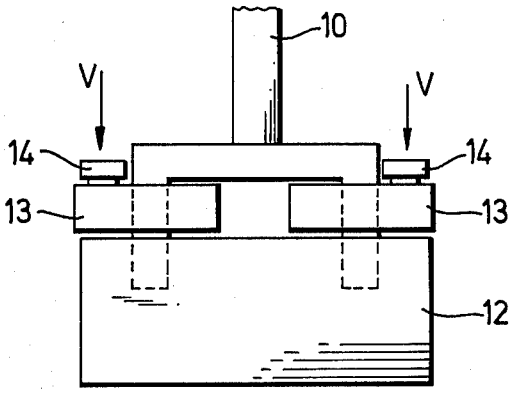
Figure 3:
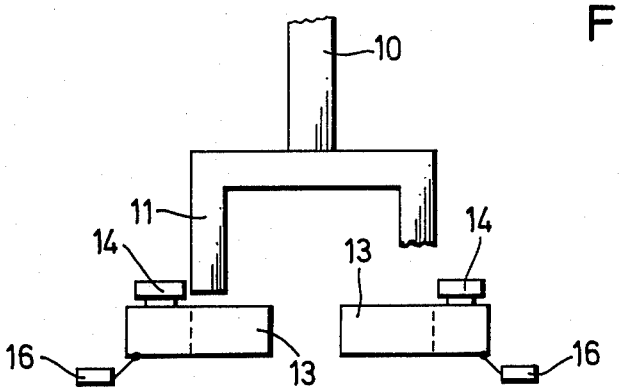

FIG. 1 shows the position of the stripper members 13 prior to the stripping operation; FIG. 2 shows the stripper members 13 advanced ready to strip off the block 12 and FIG. 3 shows the lower position of the stripper members 13 after the block 12 has been detached from the projections 11. In stripping the residue 12 from the projections 11, accidental breakage of one or more of the projections 11 can occur. FIG. 3 illustrates this situation and shows that an end portion of one of the projections 11 has been broken away and removed with the anode residue 12. To prevent the broken portion of the projection 11 from being fed with the residue 12 to a re-processing plant or to a breaker preceding such a plant, sensing means is provided. This sensing means, as exemplified here, takes the form of an inductive sensor 14 mounted on each stripper member 13 and co-operative limit switches 15,16 which sense the upper and lower positions of the stripper members 13. When the stripper members 13 are advanced up to the projections 11 (FIG. 2), each sensor 14 adopts a position in close proximity to the associated projection 11 with just a small gap therebetween. In this way, the electromagnetic coupling between each sensor 14 and its associated projection 11 can enable the sensor 14 to produce a signal indicating the presence or absence of the projection 11. As appears from FIGS. 2 and 3 (left-hand side) so long as the projection 11 in question is intact, the sensor 13 can produce the presence-indicating signal throughout the entire vertical displacement of the supportive stripper member 13. This vertical displacement is itself sensed by the switches 15,16 so that, for example, the switches 15 can initiate the sensing operation while the switches 16 terminate the operation. Alternatively, the overall sensing and control operations can be enabled by the upper switches 15 and the actuation of the lower switches 16 can gate or otherwise act to cause both sensors 14 to operate to then sense the presence or absence of the lower end portions of the projections 11. Whatever system is adopted should any projection 11 be damaged (as shown at the right-hand side of FIG. 3) the sensor 14 associated therewith will not produce a signal indicative of the presence of the projection 11 or, conversely, will produce a signal indicative of the absence of the projection 11 over at least part of the path of movement of the supportive stripping member 14. Hence, at the broken-off end of the damaged projection, the signal provided by the sensor 14 will change or otherwise signify damage to the projection 11. This signal or change can be utilized to a variety of ways, for example, the signals from the sensors 14 can be compared with one another or each sensor 14 may individually enable a control function or sequence. It is preferred to provide a control signal signifying projection damage which control signal is used to positively inhibit the re-processing of the removed residue 12 and/or to operate an alarm. In one form of control system, a conveyor transporting the anode residue is halted by the control signal and a breaker fed by the conveyor can be halted as well. The brokenoff metallic projection 11 can then be found and removed manually and the appropriate drive and control systems can then be started again manually.

We claim:

1. In apparatus for removing anode residue from anodes of electrolytic melt baths and comprising at least one stripper member which is movable in relation to a portion of an anode to strip and effect removal of the anode residue thereon; the improvement comprising a sensor carried by the stripper member for sensing the presence or absence of the anode portion, thereby to signify damage thereto.

2. In apparatus for removing anode residue from anodes of electrolytic melt baths and comprising stripper members, each movable in relation to an associated metallic projection of an anode to strip and effect removal of the anode residue thereon; the improvement comprising sensors each carried by one of the stripper members for sensing the presence or absence of the associated projection thereby to signify damage thereto.

3. Apparatus according to claim 1, wherein said sensor is an inductive sensor.

4. Apparatus according to claim 2, wherein said sensor is an inductive sensor.

5. Apparatus according to claim 2, wherein each said stripper member is movable transversally towards and away from the projection of the anode and also in a direction parallel to the longitudinal axis of the projection and wherein there is provided one or more limit switches actuated when the stripper member moves along the projection.

6. Apparatus according to claim 5, wherein the sensor and limit switch or switches serve to provide a control signal during or after the stripping operation to signify damage to the projection.

7. Apparatus according to claim 6, wherein said control signal is utilized to halt, indirectly or directly, a subsequent re-processing operation to recover the anode residue to enable a metallic portion of a damaged projection to be removed.

* * * * *